United States Patent [19]

Yamamoto et al.

[11] 4,301,136

[45] Nov. 17, 1981

[54] PROCESS FOR CONTINUOUS GRAPHITIZATION OF GRAPHITIZABLE PRECURSOR FIBERS

[75] Inventors: Ryuichi Yamamoto; Shizuo Watanabe, both of Ehime, Japan

[73] Assignee: Toray Industries, Incorporated, Tokyo, Japan

[21] Appl. No.: 147,162

[22] Filed: May 16, 1980

Related U.S. Application Data

[63] Continuation-in-part of Ser. No. 15,000, Feb. 26, 1979, abandoned.

[30] Foreign Application Priority Data

Feb. 27, 1978 [JP] Japan ..... 53/20896

[51] Int. Cl.[3] ..... D01F 9/22

[52] U.S. Cl. ..... 423/447.8; 423/447.4; 423/447.6; 423/448

[58] Field of Search ..... 423/447.8, 447.4, 447.6, 423/448; 264/29.2

[56] References Cited

U.S. PATENT DOCUMENTS

| | | | |
|---|---|---|---|
| 3,700,511 | 10/1972 | Whitney et al. | 423/447.6 |
| 3,764,662 | 10/1973 | Roberts | 423/447.6 |
| 3,900,556 | 8/1975 | Clarke | 423/447.8 |
| 3,954,950 | 5/1976 | Ram et al. | 423/447.6 |

FOREIGN PATENT DOCUMENTS

| | | | |
|---|---|---|---|
| 1215005 | 12/1970 | United Kingdom | 423/447.8 |

*Primary Examiner*—Edward J. Meros
*Attorney, Agent, or Firm*—Miller & Prestia

[57] ABSTRACT

An improved process for manufacturing high-grade and high-quality graphite fibers by the steps of (a) heating carbon fibers from acrylic fibers in an initial heating zone while exposed to an atmosphere of inert gas having a maximum temperature from about 1700° C. to 1900° C., and (b) then heating the resulting fibers in a subsequent heating zone while exposed to an atmosphere of inert gas having a maximum temperature from 2300° C. to 2700° C.

6 Claims, 3 Drawing Figures

PROCESS FOR CONTINUOUS GRAPHITIZATION OF GRAPHITIZABLE PRECURSOR FIBERS

This is a continuation-in-part of application Ser. No. 15,000 filed Feb. 26, 1979, now abandoned.

BACKGROUND OF THE INVENTION

Graphite fibers are generally different from carbon fibers in respect of carbon content (purity), fiber structure and fiber characteristics, for example. Graphite fibers are much more useful and effective than carbon fibers when used in sports equipment such as fishing rods and golf club shafts which require high modulus, when used in electric components such as heaters which require high purity and low resistivity and when used for aerospace parts such as aircraft, rockets and the like which require oxidation resistivity and high precision. However, graphite fibers cost much more than carbon fibers and this high cost is largely a result of difficulties in manufacturing processability and productivity. An inert atmosphere is required for production of graphite fibers, and a higher temperature is used than for carbon fibers.

Efforts have been made to increase productivity in manufacturing graphite fibers. For example, it has been proposed to increase the temperature gradient and to shorten the residence time in the graphitizing furnace. However, this produces increased amounts of fuzz on the graphite fiber surfaces and occasionally causes breakage of the running fiber strands.

Also, these modifications tend to reduce the tensile strength of the fibers. Further, since the temperature of the inert atmosphere must be higher than that used for manufacturing carbon fibers, the wear and tear on the graphitizing furnace, particularly on its heating pipes, is very considerable. With such wear and tear due to exceedingly high temperatures, deviations from the desired temperature profile tend to increase very substantially and the furnace tube must be frequently changed. This seriously interferes with productivity and processability, and also consumes large amounts of energy, labor and materials.

With regard to such a graphitizing method, there are one-stage graphitizing methods such as disclosed in U.S. Pat. Nos. 3,700,511, 3,900,556, 3,954,950, 3,764,662 and British Pat. No. 1,215,005.

U.S. Pat. No. 3,700,511 shows a conventional graphitizing method for making a carbon fiber from a fiber which is first oxidized in the temperature range of from 1000° C. to 1600° C. and then successively pyrolyzed up to a temperature of 2500° C. in a graphitizing zone.

U.S. Pat. No. 3,900,556 shows a process for preparing a graphite fiber by rapidly graphitizing an oxidized fiber in a short period of time, such as from 10 seconds to 60 seconds. However, according to this method, it is difficult to obtain as good a temperature profile as possible by this invention. Also, in a rapid graphitizing process, the oxidized fiber is heated very rapidly and develops excessive surface fuzz and tends to break off easily.

U.S. Pat. No. 3,900,556 also shows a rapid graphitizing method. However, the method is in respect to an oxidized fiber, and it uses a carbonizing and one-stage graphitizing procedure. By this method, it is difficult to obtain a small temperature gradient in the vicinity of 1700° C. which is essential in order to obtain a good graphite fiber.

U.S. Pat. No. 3,764,662 discloses a method wherein oxidized fiber is heated at a temperature from 1300° C. to 1800° C. for at least an hour and then a graphite fiber is obtained by heating at a further temperature of from 2300° C. to 3000° C. for 30–90 seconds. However, this method is not practical for an industrial process because of the very long heating time in the first stage. Similarly, the procedure according to British Pat. No. 1,215,005 would not be practical as a commerical process. According to British Pat. No. 1,215,005 a graphite fiber is obtained by successively subjecting an organic fiber, through a first oxidizing furnace to a fourth graphitizing furnace. However, the heat increase rate from the second to the third furnace, which have a temperature range from 1000° C. to 1700° C., is very slow, i.e., 300° C./hr. Also, the residence time in the furnace is very long, namely, from 30 minutes to 4 hours in the second furnace and a maximum of 3 hours in the third furnace. Moreover, the residence time in the temperature range of 2000° C. or more in the fourth graphitizing furnace is also from 30 minutes to 2 hours. Overall, such a process would not be a practical industrial process.

It is an object of this invention to provide a stable method of manufacturing high grade and high quality graphite fibers from carbon fibers made from acrylic fibers, particularly, it is an object to manufacture graphite fibers which have a minimum of surface fuzz. Another object is to provide a process for shortening the heating zone. Another object of this invention is to provide a method of manufacturing graphite fibers in which the matter of changing parts such as furnace tubes and the like, can be easily carried out, wherein the life of the parts is lengthened, costs for energy, materials and labor are materially reduced.

These and other objects are attained by the present process by providing a graphitizing furnace which is divided into two zones and by utilizing specific temperature ranges.

Figure 1:
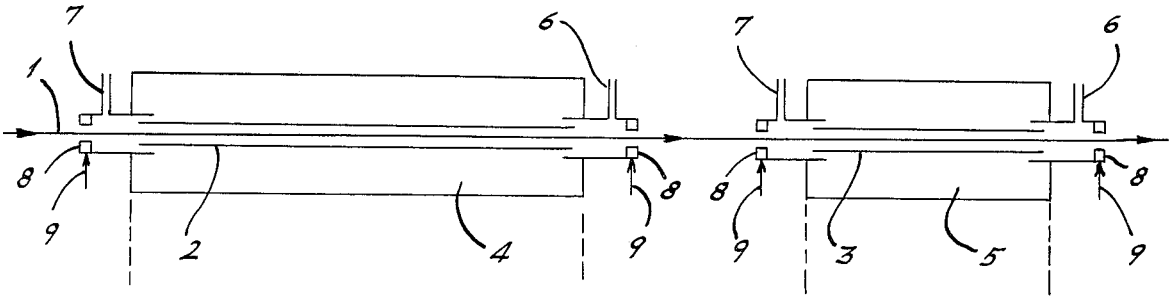
FIG. 1 is a view in longitudinal section of one form of graphitizing, apparatus for carrying out the process of this invention.

Although the drawings disclose specific embodiments which have been selected for illustration herein, these are not intended to define or to limit the scope of the invention, which may be practiced in a wide variety of different ways, all as defined in the appended claims.

DETAILED DESCRIPTION OF THE INVENTION

The term "graphite fiber" as used in the description of this invention is intended to mean a fiber which is obtained by heating a graphitizable precursor fiber in an inert atmosphere at a temperature of at least about 2300° C., and which fiber contains at least about 95% by weight of carbon. The term "precursor fiber" is intended to mean a fiber which has sufficient structural integrity to maintain its fiber shape and which can be converted to a graphite fiber in an inert atmosphere at a temperature of at least about 2300° C. A typical example is a carbon fiber obtained by heating an oxidized fiber in an inert atmosphere at a temperature of at least about 800° C., preferably 1,000°–1500° C. In the practice of the present invention, however, it is preferable to use a carbon fiber obtained from an acrylic fiber consisting essentially of at least about 95 mol % of acrylonitrile (AN) and up to about 5 mol % of one or more ethylene-type vinyl compounds which are copolymeriazable with AN.

In accordance with this invention it has been discovered that unexpected advantages are obtained by converting the carbon fibers to graphite fibers by heating them in an inert atmosphere in successive zones, particularly to heat the carbon fibers in a front heating zone containing an inert atmosphere, the maximum temperature of which is about 1700° C. to 1900° C., then to heat the fibers in a rear heating zone containing an inert atmosphere, the maximum temperature of which is about 2300° C. to 2700° C.

It has been discovered that if the front and rear heating zones are operated at heating temperature outside the ranges from 1700° C. to 1900° C. and 2300° C. to 2700° C., respectively, it is difficult to obtain high grade and high quality graphite fiber in a stable manner. In particular, depending upon the type of carbon fiber and upon the temperature profile of the heating zone, difficulties are encountered if the maximum temperature of the front heating zone exceeds about 1900° C. In particular, the running fibers tend to develop excessive surface fuzz and tend to break off easily.

It is preferable to control the heating rate of the front heating zone from about 300° C./min to about 2000° C./min, more preferably from about 500° C./min to about 1500° C./min. It is also preferable to control the heating rate of the rear heating zone from about 2000° C./min to about 10000° C./min.

The heating rate of the front heating zone relates to the mean heating rate from 1300° C. to the maximum temperature minus 100° C. The substantial effective temperature in the front heating zone is 1300° C. or more. Similarly, the heating rate of the rear heating zone relates to the mean heating rate from 1900° C. to the maximum temperature minus 100° C.

The treating time of the carbon fiber in the front heating zone, which is defined as the residence time of the fibers in the zone at a temperature above 1300° C., is preferably controlled to maintain it in the range of about 10 seconds to 10 minutes, more preferably about 30 seconds to 3 minutes.

The present invention will now be further and more particularly described with reference to the drawings.

Referring to FIG. 1, the numerals (I) and (II) designate, respectively, the separate front and rear heating zones (furnaces) as described herein. Furnaces (I) and (II) respectively have furnace tubes (2) and (3) to which heat is applied in a manner known per se. (1) is a carbon fiber to be treated, (4) and (5) represent insulation on the said furnaces, (6) are supply pipes for conducting an inert gas such as nitrogen into the furnaces, (7) are off-gas exhaust pipes, (8) are furnace seals, and (9) are supply pipes for supplying an inert gas such as nitrogen to the seals.

Figure 2:
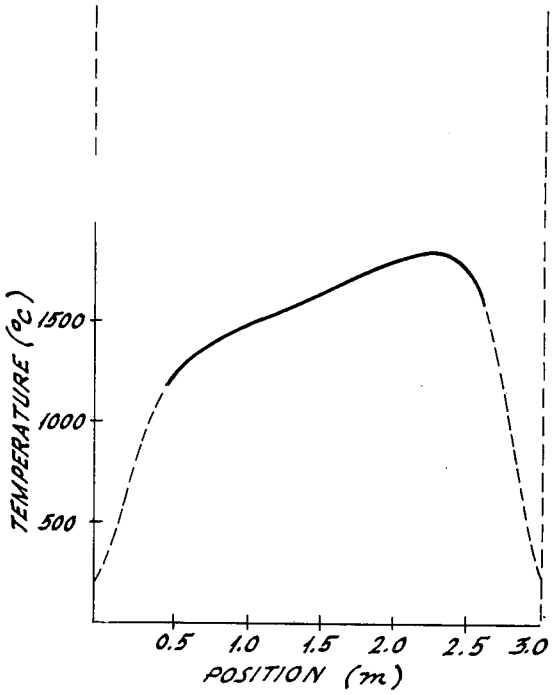
FIGS. 2 and 3, respectively, show typical examples of temperature profiles at the furnace tubes used in successive heating zones.
Figure 3:
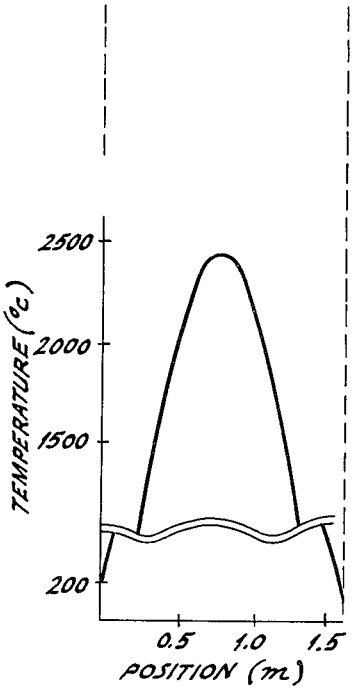

As shown in FIG. 1, the precursor fiber (1) is first conducted through the seal (8) into the furnace tube (2) of the furnace (I) comprising the initial or front heating zone. Inside this furnace tube (2), the temperature profile is controlled as shown in FIG. 2. This is done by locally controlling in a manner known per se. The carbon fiber is treated in this furnace until its weight is reduced to about 93% to 95%, and then it is conducted into the furnace tube (3) of the furnace (II) comprising the subsequent or rear heating zone. There the fiber is heated again, and is converted into a graphite fiber. FIG. 3 provides an example of a typical temperature profile of the furnace tube (3) of the rear heating zone, the maximum temperature of which is set at about 2500° C., or in the range of about 2300° C. to 2700° C. as herein described.

As a result of the present invention, much more efficiency is realized in the manufacture of graphite fibers, and the process is much more profitable, as described hereinafter: (a) The heating zone is divided into two zones independently controlled. The resulting heat rate flexibility as between the front and rear heating zones becomes substantial. Both temperature profile and heat rate can be varied easily and through the desired range. This simplifies furnace design and leads to better temperature profile control. (b) Usually, the weight loss of the carbon fiber up to the heat treatment at 1700° C. is large. It has been found that the use of a higher heat rate, up to 1700° C., tends to damage the precursor fiber. In the case of a single heating zone conventionally practiced, the overall heat rate must be so low that the productivity must be reduced. On the other hand, as a result of this invention, it is now possible to select optimum and critical heat rates for the front and rear heating zones independently of each other. Thus, it is possible to produce high grade and high quality graphite fibers and to be highly productive in doing so. (c) With the process of the present invention, it is possible to reduce the overall length of the heating zone by dividing it, and the maintenance and custody of the furnace becomes very easy. For example, when the rear heating zone includes a furnace tube, its life is much shorter than the front furnace, because of the high temperature at which it operates. However, if the tube is short, it is easy to remove and replace, the cost of the materials is low and the consumption of energy is also surprisingly lowered. This is because it has been found possible to string up the process with fibers without lowering the temperature of the furnace.

The present invention will now be further described with reference to the following Examples.

EXAMPLE 1 AND COMPARATIVE EXAMPLES 1–7

Carbon fibers were produced from acrylic fibers and carbonized in an inert atmosphere, the maximum temperature of which was 1100° C. They were taken from creels and heated to produce graphite fibers using separate furnaces as shown in FIG. 1 and using the conditions shown in Table 1. The Comparative Examples show operations outside the scope of this invention.

TABLE 1

| | MAXIMUM TEMP. | | HEAT RATE | | PASSING TIME | |
|---|---|---|---|---|---|---|
| | FRONT FURNACE [°C.] | REAR FURNACE [°C.] | FRONT FURNACE (from 1300° C. to 1700° C.) [°C./min] | REAR FURNACE (from 1900° C. to 2350° C.) [°C./min] | FRONT FURNACE (sec.) | REAR FURNACE (sec.) |
| EXAMPLE | | | | | | |

TABLE 1-continued

| | MAXIMUM TEMP. | | HEAT RATE | | PASSING TIME | |
|---|---|---|---|---|---|---|
| | FRONT FURNACE [°C.] | REAR FURNACE [°C.] | FRONT FURNACE (from 1300° C. to 1700° C.) [°C./min] | REAR FURNACE (from 1900° C. to 2350° C.) [°C./min] | FRONT FURNACE (sec.) | REAR FURNACE (sec.) |
| 1 | 1800 | 2450 | 750 | 4000 | 90 | 50 |
| COMPARATIVE EXAMPLES | | | | | | |
| 1 | not used | 2450 | — | 4000 | — | 50 |
| 2 | 1400 | 2450 | 6000 | 4000 | 90 | 50 |
| 3 | 1800 | 2450 | 3000 | 1600 | 90 | 50 |
| 4 | 2250 | 2450 | 2100 | 4000 | 90 | 50 |
| 5 | 2450 | not used | 2100 | — | 90 | — |
| 6 | 1800 | 2450 | 90 | 500 | 720 | 400 |
| 7 | 1800 | 2450 | 7500 | 40000 | 9 | 5 |

The resulting data are shown in Table 2. Moreover, the usual temperatures, the periods of time between changes of furnace tubes and the number of days required to change them, with respect to both front and rear furnaces, are shown in Table 3.

TABLE 2

| | Tensile Strength (kg/mm$^2$) | Young's Modulus ($10^3$kg/mm$^2$) | Surface Fuzz (amount formed) | Fiber Breakage | Carbon Fiber Yield (%) After Front Heating Zone | Carbon Fiber Yield (%) After Rear Heating Zone |
|---|---|---|---|---|---|---|
| EXAMPLE | | | | | | |
| 1 | 260 | 40.5 | very little | none | 93.7 | 93.1 |
| COMPARATIVE EXAMPLES | | | | | | |
| 1 | 171 | 37.3 | very much | frequent | — | 93.5 |
| 2 | 183 | 39.0 | very much | none | 95.8 | 93.2 |
| 3 | 204 | 38.1 | much | considerable | 94.6 | 93.5 |
| 4 | 212 | 40.4 | much | none | 93.5 | 93.0 |
| 5 | 177 | 41.2 | much | considerable | 92.9 | — |
| 6 | 258 | 42.7 | considerable | none | 93.3 | 92.2 |
| 7 | 159 | 36.9 | very much | frequent | 96.2 | 94.3 |

TABLE 3

| | Maximum Temperature | Period between Changes | Days for Changing |
|---|---|---|---|
| Front furnace | 1800° C. | 6 months | 2 |
| Front furnace | 2450° C. | 20 days | 2 |
| Rear furnace | 2450° C. | 1 month | 0.5 |

We claim:

1. A process for continuously graphitizing a carbon fiber obtained from an acrylic fiber consisting essentially of at least about 95 mol % of acrylonitrile and up to about 5 mol % of one or more ethylene-type vinyl compounds which are copolymerizable with acrylonitrile which comprises passing the fiber successively through a first and a separate second heating zone, each of said zones containing an inert atmosphere and having a temperature of at least 800° C., maintaining the maximum temperature of the first heating zone at about 1700° to about 1900° C., a heating rate which is a mean heating rate of from about 1300° C. to the maximum temperature minus 100° C. at about 300° C./min to 2000° C./min, and a heating time of about 10 seconds to 10 minutes, and maintaining the maximum temperature of the second heating zone at about 2300° C. to about 2700° C.

2. The process according to claim 1, wherein the heating rate of said second zone is a mean heating rate of from 1900° C. to the maximum temperature minus 100° C. is at about 2000° C./min to 10000° C./min and the total heating time of the treated fiber in the heating zones is about 10 seconds to about 5 minutes.

3. The process according to claim 2, wherein the heating rate of said first heating zone is about 500° C./min to 1500° C./min.

4. The process according to claim 1, wherein said carbon fiber is obtained at the maximum temperature of about 800° C. to 1500° C. in an inert atmosphere.

5. The process according to claim 4, wherein said carbon fiber is obtained at the maximum temperature of about 1000° C. to 1500° C.

6. The process according to claim 3, wherein the heating time in said first heating zone is about 30 seconds to about 3 minutes.

* * * * *